US007383849B2

(12) United States Patent
Kline

(10) Patent No.: US 7,383,849 B2
(45) **Date of Patent: *Jun. 10, 2008**

(54) BED ENCLOSURE

(75) Inventor: Charles R. Kline, Bellflower, CA (US)

(73) Assignee: J.T. Posey Company, Arcadia, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/356,874

(22) Filed: Feb. 17, 2006

(65) Prior Publication Data

US 2006/0137729 A1 Jun. 29, 2006

Related U.S. Application Data

(63) Continuation of application No. 10/316,226, filed on Dec. 10, 2002, now Pat. No. 7,047,991.

(51) Int. Cl.
*E06H 15/02* (2006.01)
*A47C 29/00* (2006.01)

(52) U.S. Cl. ..... 135/96; 5/414; 5/424

(58) Field of Classification Search ..... 135/96, 135/121, 124, 137, 157; 5/414, 97, 98.1, 5/424, 507, 512, 600, 658
See application file for complete search history.

(56) References Cited

U.S. PATENT DOCUMENTS 875,206 A 12/1907 Osborne
952,879 A 3/1910 Crocker
1,625,673 A 4/1927 Nelson
1,657,708 A 1/1928 Berbig
1,737,664 A * 12/1929 Maness ..... 135/142
1,892,913 A * 1/1933 Timm ..... 5/738
2,210,342 A * 8/1940 Sater ..... 135/140
2,223,568 A 12/1940 Krasnov ..... 5/354
2,612,646 A 10/1952 Sussman ..... 5/354
2,820,468 A 1/1958 Park et al. ..... 135/5
2,847,017 A 8/1958 Drago ..... 135/3
2,907,055 A 10/1959 Berman ..... 5/334
2,931,373 A 4/1960 Larson ..... 135/1
3,703,181 A 11/1972 Tholen ..... 135/1
4,164,797 A 8/1979 Golembeck ..... 5/470
4,304,018 A 12/1981 McClam ..... 50/494
4,521,048 A 6/1985 Prvanoff ..... 296/160
4,616,797 A * 10/1986 Cramer ..... 248/227.4
4,641,387 A 2/1987 Bondy et al. ..... 5/508

(Continued)

OTHER PUBLICATIONS

Advertising flier VAIL Enclosed Bed Systems, "There's Only One Way to Spell Quality", http://www.vailbed.com.

(Continued)

*Primary Examiner*—Anita M. King
(74) *Attorney, Agent, or Firm*—Jeffrey G. Sheldon; Michael Fedrick; Sheldon Mak Rose & Anderson

(57) ABSTRACT

A bed enclosure comprises a frame, a tent supported by the frame, and a mattress cover. Material covering two opposed upright end members of the frame and an upper support bar extending between the upright end members is connected to the tent by zipper connectors. A lower edge of the tent is likewise connected to an upper edge of the mattress cover with a zipper connector.

19 Claims, 6 Drawing Sheets

U.S. PATENT DOCUMENTS

| | | | | | |
|---|---|---|---|---|---|
| 4,706,313 | A | | 11/1987 | Murphy | 5/464 |
| 4,852,598 | A | | 8/1989 | Griesenbeck | 135/102 |
| 5,010,611 | A | | 4/1991 | Mallett | 5/497 |
| 5,033,493 | A | | 7/1991 | Senchuck | 135/113 |
| 5,136,741 | A | | 8/1992 | Balonick et al. | 5/470 |
| 5,190,305 | A | * | 3/1993 | Putman | 280/79.3 |
| 5,303,434 | A | | 4/1994 | Arnold | 5/414 |
| 5,384,925 | A | | 1/1995 | Vail | 5/424 |
| 5,494,066 | A | | 2/1996 | McMahan | 135/87 |
| 5,609,321 | A | * | 3/1997 | McClellan | 248/534 |
| 5,642,750 | A | | 7/1997 | Brown et al. | 135/137 |
| 5,699,820 | A | | 12/1997 | Evans et al. | 135/96 |
| 5,743,412 | A | * | 4/1998 | Noble | 211/59.2 |
| 5,784,732 | A | | 7/1998 | Vail | 5/430 |
| 6,065,164 | A | | 5/2000 | Swanger et al. | 5/420 |
| 6,079,678 | A | * | 6/2000 | Schott et al. | 248/229.15 |
| 6,098,218 | A | | 8/2000 | Ventura | 5/113 |
| 6,163,906 | A | | 12/2000 | Kay | 5/662 |
| 6,216,291 | B1 | | 4/2001 | Eads et al. | 5/424 |
| 6,263,529 | B1 | | 7/2001 | Chadwick et al. | 5/414 |
| 6,360,384 | B1 | | 3/2002 | Kuempel | 5/414 |
| 6,381,778 | B1 | | 5/2002 | Peterson | 5/497 |
| 6,634,042 | B2 | | 10/2003 | Blossman | 5/499 |
| 6,687,930 | B1 | | 2/2004 | Eads et al. | 5/414 |
| 6,694,547 | B1 | | 2/2004 | Vail | 5/424 |
| 6,722,458 | B2 | | 4/2004 | Hofbauer | 180/65.4 |
| 6,952,844 | B2 | | 10/2005 | Danaher | 5/414 |
| 7,047,991 | B2 | * | 5/2006 | Kline | 135/96 |
| 2005/0217026 | A1 | | 10/2005 | Ramirez | 5/93.1 |
| 2005/0235418 | A1 | | 10/2005 | Jacques, II et al. | 5/424 |

OTHER PUBLICATIONS

Advertising flier for SafeTCare, "The Restraint Alternative", SafeTCare Manufacturing Company, 5802 Gardendale, Houston, Texas 77092.

Brochure, "Canopy Enclosed Beds From Pedicraft,"Pedicraft, P.O. Box 5969, Jacksonville, FL 32247-5969, 4 pages.

Advertising Flyer, Safe-N-Secure Bed Enclosure System, Homecare Solutions, 3614 Kennedy Road, South Plainfield, New Jersey 07080, 1 page.

Internet Cite, "GeriTent, Dedicated to the finest in Patient Safety,", GeriTent Interprises, Inc., at www.geritent.com, 7 pages.

Brochure, Vail Enclosed Bed Systems, "Reduced the Cost of Patient Care, without Reducing the Care," Vail Products, Inc., 235 First Street, Toledo, OH 43606,4 pages.

* cited by examiner

BED ENCLOSURE

CROSS-REFERENCE TO RELATED APPLICATIONS

This application is a continuation of prior application Ser. No. 10/316,226, filed on Dec. 10, 2002 and titled "BED ENCLOSURE," which has now issued as U.S. Pat. No. 7,047,991.

BACKGROUND

In medical treatment situations, it is sometimes necessary to physically restrain certain persons or patients in order to provide protection for themselves and/or others. For example, adults and children having dementia, psychiatric or mental disorders, or other kinds of physical and/or mental problems may need to be restrained. In the past, these people have been physically restrained by using ties, straps or vests. However, the use of these kinds of restraints can be uncomfortable. In addition, these kinds of restraints are frequently removed during the day for a variety of reasons, such as to allow the person to exercise his or her muscles, or to clean or feed the person.

One alternative to using physical restraints involves the use of an enclosure restricting egress to a bed, typically referred to as a bed enclosure. Typically, the bed enclosure includes a supporting frame and a covering which is fitted over the sides and the top of the framework. The covering is provided with zippered side and end panel areas which can be readily opened and closed in order to provide access to the interior of the enclosure. Thus, the bed enclosure provides a more humane, safe and less restrictive environment for the person.

Unfortunately, a major problem with the use of such bed enclosures is an inability to move the bed enclosure after it is installed. Typically, specialized personnel must be called in so as to move the bed enclosure. In certain circumstances, the bed enclosure must be disassembled so that the hospital bed (on the interior of the bed enclosure) can be moved. In other circumstances, in order to move a patient from the bed enclosure to another location, the patient needs to be lifted and transferred to a mobile bed. The difficulty in actually moving the bed enclosure has discouraged the use of such enclosure beds.

Another problem is that some bed enclosures are not easily removable in emergency situations. For example, if a patient is having a heart attack, the medical personnel need unobstructed access to the patient. In this situation, conventional panels in the walls of the enclosure that allow access to the patent can be burdensome and obstruct medical personnel from their task at hand.

Another problem is that there are a variety of different styles of beds. Some bed enclosures are limited in their ability to be securely and easily attached to different beds while remaining capable of easily disassembly from the bed when there is no further need for the enclosure.

Another problem with some bed enclosures is that the patient inside of a bed enclosure can easily make contact with frame components that connect the bed enclosure to the bed.

Another problem with some bed enclosures is that attachments and adjustments to the enclosure's frame that attaches to the bed can require an installer to spend time connecting components in a cramped area under the bed. For example, in U.S. Pat. No. 6,216,291 to Eads, the bed enclosure attaches underneath the bed.

Another problem with bed enclosures is that many bed enclosures can hamper or limit medical personnel's ability to effectively use devices to lift a patient into and out of the bed. For example, a patient lifting device (such as one of several models of floor based Hoyer Lifts for patients, manufactured by Sunrise Medical, 2382 Faraday Avenue, Carlsbad, Calif., 92008) requires sufficient clearance under at least one side of the bed to provide stability to properly use the device.

Examples of other bed enclosures are U.S. Pat. No. 5,784,732 to Vail, U.S. Pat. No. 5,384,925 to Vail, and U.S. Pat. No. 6,263,529 to Chadwick et al. These bed enclosures suffer from one or more of the above problems.

Accordingly, a need exists for a bed enclosure that can be easily and securely attached to a variety of different beds without the need for specialized installers; can be easily and quickly removed from a bed; provides safety in the internal area accessible by the patient; and permits easy access to the patient by medical personnel outside of the bed enclosure.

SUMMARY

The present invention satisfies this need by providing an enclosure that can be used to restrict egress, such as by a patient, from a bed. The enclosure comprises a frame having a pair of opposed end bars, each having first and second segments, at least one side bar connected to the first end segment of each end bar, and a first and second opposed upright end member. The end bars and upright end members are for placement proximate to the head and foot of the bed. The upright end members are each connected to an opposed end bars. An upper support bar is connected between the opposed upright end members.

Preferably there is only one side bar to allow unobstructed access underneath the bottom of the bed.

Preferably there is a first attachment bar for placement at an end of the frame. The first attachment bar supported between a first upright end member comprising two substantially upright legs having an upper and a lower portion. The first attachment bar is moveable up and down along at least a portion of the legs. A releasable fastener connects the first attachment bar to the bed, such as to the bed framework, to keep the frame, according to the present invention, from moving out of place. More preferably there is also a second attachment bar on the second opposed upright end member.

A tent is supported by the frame, and has opposed side walls, opposed end walls, and an open bottom. Each wall of the tent has a lower edge. Preferably there is a half of a first mated zipper connector along the lower edge of at least one tent wall for connection to a mattress cover having an upper edge with the other half mating of the first mated zipper connector. This allows the tent to be zippered to the mattress cover, providing further structural support for the enclosure, additional protection, and added safety for a patient on the bed.

It is preferred that the present invention utilize all of these preferred features, but it is to be recognized that it is advantageous to have only one of these features. Therefore the present invention is not limited to structures that include all preferred features.

DRAWINGS

These and other features, aspects and advantages of the present invention will become better understood with regard to the following description, appended claims and accompanying drawings where:

DESCRIPTION

Figure 1:
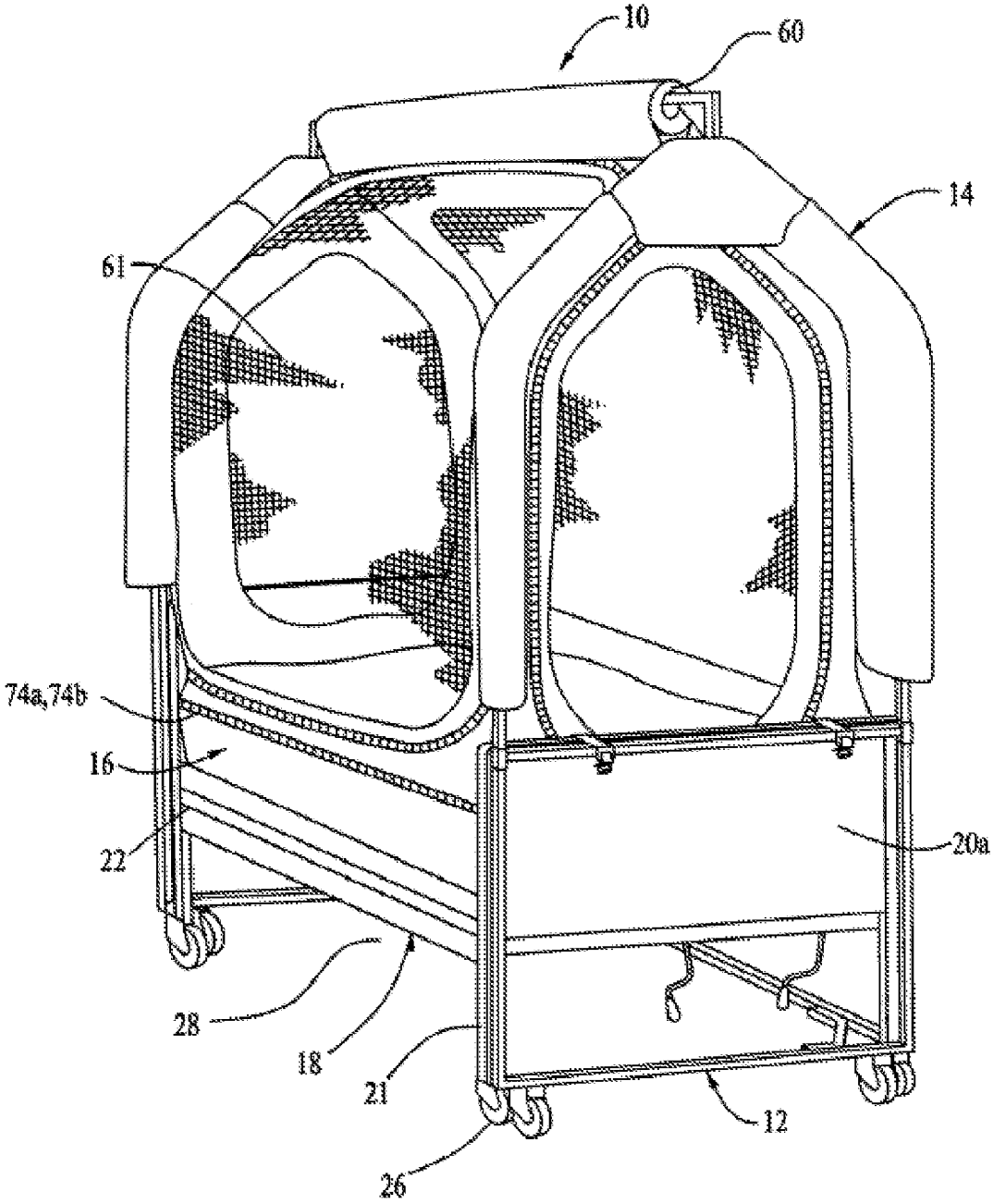
FIG. 1 is a perspective view of an enclosure for restricting egress to a bed in accordance with the present invention, including an open side allowing unobstructed access underneath the bottom portion of the bed.

The following discussion describes embodiments of the invention and several variations of these embodiments. This discussion should not be construed, however, as limiting the invention to these particular embodiments. Practitioners skilled in the art will recognize numerous other embodiments as well.

In the following description of the invention, certain terminology is used for the purpose of reference only, and is not intended to be limiting. Terms such as "upper", "lower," "above," and "below," refer to directions in the drawings to which reference is made. Terms such as "inward" and "outward" refer to directions toward and away from, respectively, the geometric center of the component described. Terms such as "side," "top," "bottom," "horizontal," and "vertical," describe the orientation of portions of the component within a consistent but arbitrary frame of reference which is made clear by reference to the text and the associated drawings describing the component under discussion. Such terminology includes the words specifically mentioned above, derivatives thereof, and words of similar import.

As used herein "bed" includes the bed's framework with or without IV pole slots on the framework, the bed board with or without IV pole slots, the mattress support, and the mattress. As used herein "bed board" means the foot board of the bed frame or the head board of the bed frame. The orientation of the person in the bed often determines whether it is deemed to be a foot board or head board. Some beds have bed boards or framework with slots or holes that are often used to insert the poles that hold intravenous fluid bags, traction equipment, head or foot boards, or for other purposes. As used herein these slots are referred to herein as "IV pole slots," and other interchangeable names for these slots are "trapeze support brace holes" and "traction pole mounting holes."

As used herein, a bed having a "bottom portion," the "bottom portion" refers to the portion of the bed that is below or underneath the mattress support of the bed.

As used herein, "releasable fastener" structure means a fastener that can engage or attach or connect to the bed, and also can disengage or release its engagement or attachment to the bed. When the fastener is engaged or attached or connected to the bed, there is a secure connection. When the fastener is disengaged, the fastener can be removed from the bed. Examples of "releasable fasteners" include bolts, clamps, C-clamps, straps, ratchet straps, screws, and other similar structures.

As used herein, the term "bar" means bar, pole, shaft, rod, staff, tube, pipe, and include hollow and solid versions. The term "bar" also includes bars that are composed one piece or have more than one segment to constitute the bar. For example, bars used according to the present invention can be made as a one piece bar or the same bar can be made up of more than one piece.

Referring generally to FIGS. 1-4, an enclosure 10 embodying features of the present invention comprises a frame 12, a tent 14 supported by the frame 12, and a mattress cover 16 having an upper edge that is removably connected to the tent 14. The enclosure is used with a bed 18 having a bottom portion, which has opposed bed boards 20*a* and 20*b*, either of which can serve as a head board and either of which can serve as a foot board, a bed framework 21, a mattress support 22, a mattress 24, wheels 26, and an open side 28 underneath the mattress support 22.

Figure 2:
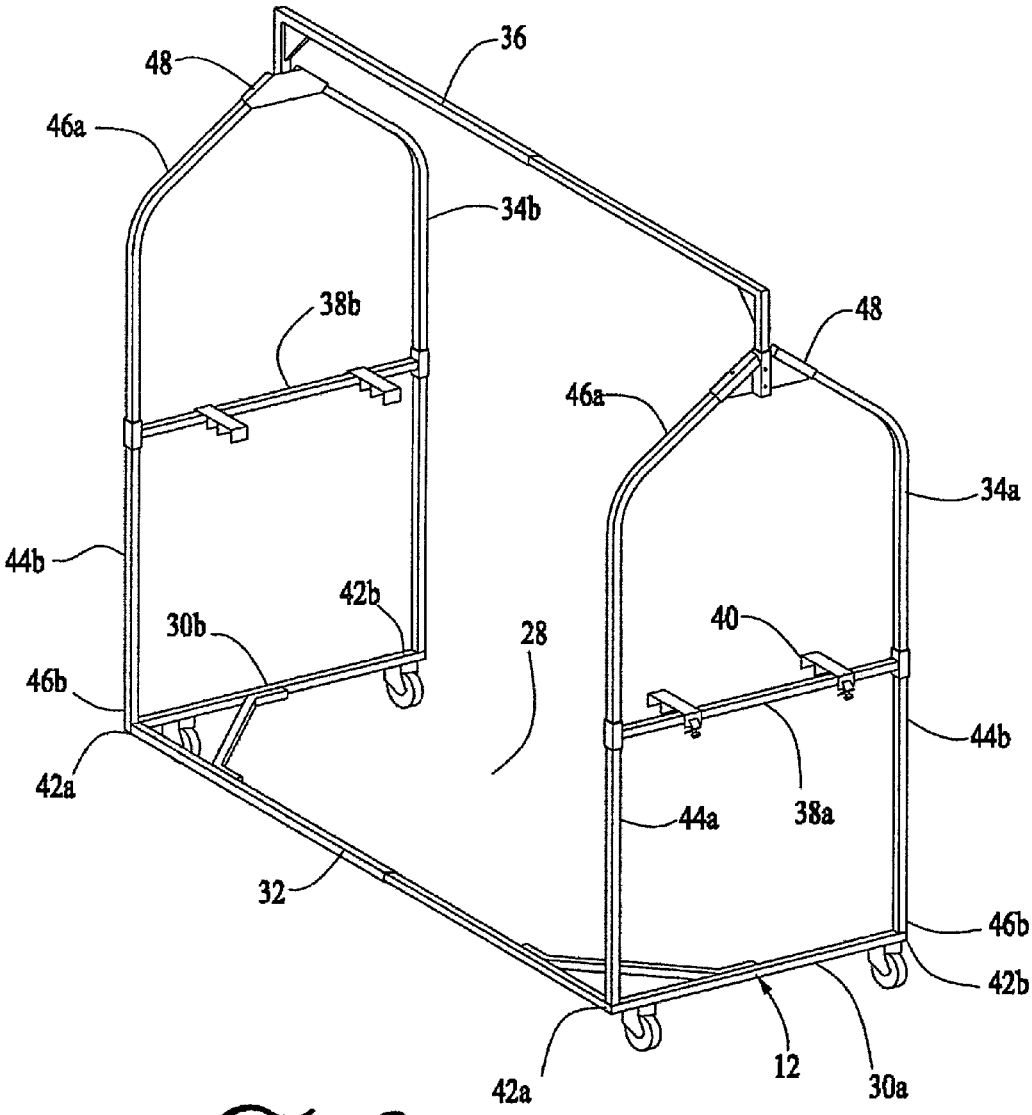
FIG. 2 is a perspective view of the frame of the enclosure of FIG. 1.

As best shown in FIG. 2, the frame 12 comprises a pair of opposed end bars 30*a* and 30*b*, one side bar 32, a first and second opposed upright end members 34*a* and 34*b*, an upper support bar 36, a first attachment bar 38*a* and a second attachment bar 38*b*, and a bed board fastener 40. Each of the opposed end bars 30*a* and 30*b* has a first end segment 42*a* and a second end segment 42*b*. Each upright end member 34*a* and 34*b* comprises two substantially upright legs 44*a* and 44*b* having an upper portion 46*a* and a lower portion 46*b*; and a substantially V-shaped connector segment 48 connecting the legs 44*a* and 44*b* at the upper portion 46*a*.

The interrelationship of the components of the frame 12 is best seen in FIG. 2. The opposed end bars 30*a* and 30*b* provide locations for connections at the bottom of the frame 12 for the side bar 32 and the first and second opposed upright end members 34*a* and 34*b*. The side bar 32 is connected to the first end segment 42*a* of each opposed end bar 30*a* and 30*b*, and there is no side bar 32 connected to the second end segments 42*b* to define a generally rectangular shape with an open side 28 allowing unobstructed access underneath the bottom portion of the bed 18. The end bars 30*a* and 30*b* are also connected to each opposed upright end members 34*a* and 34*b*. The legs 44*a* and 44*b* of each upright end member 34*a* and 34*b* are connected at the lower portion 46*b* to the opposed end bars 30*a* and 30*b*. The first and second attachment bars 38*a* and 38*b*, as shown in FIG. 2, are connected between the legs 44*a* and 44*b* of each upright end member 34*a* and 34*b*, and are moveable up and down along at least a portion of the length of the legs 44*a* and 44*b*. Two bed board fasteners 40 are shown as attached to each attachment bar 38*a* and 38*b*. The upper support bar 36 extends between and connects to the substantially V-shaped connector segments 48 of each upright end member 34*a* and 34*b*.

Preferably, there is only one side bar to allow unobstructed access underneath the bed. Preferably, there is only one upper support bar.

While most frames of a bed enclosure have two sides under the bed that form a generally rectangular shape, it is not necessary that the frame of the bed enclosure form a rectangular shape. A preferred version of the invention contemplates any shape that has the requisite open side underneath the bed allowing unobstructed access to the bottom of the bed. However, the generally rectangular shape of the frame of the bed enclosure is consistent with the current shape of most beds as generally rectangular.

In an embodiment of the invention shown in the drawings, a substantially V-shaped connector segment connects the upper portion of the legs of each opposed upright end members, and also connects between the first and second opposed end members. The use of the substantially V-shaped connector segment is optional. For example, the legs of each opposed upright end members could be bent to form a V-shape or U-shape, and not require a connector to connect the legs of the opposed upright end members.

While the drawings and descriptions of connector segments of each upright end member show a substantially V-shaped connector segments, the invention contemplates that other shapes of connector segments can be used without deviating from the invention claimed in this patent. The substantially V-shaped connector segment is a preferred connector segment, and "substantially V-shaped" as used herein, refers to triangle shaped, or U-shaped, and includes variations with rounded apexes or pointed apexes.

Figure 5:
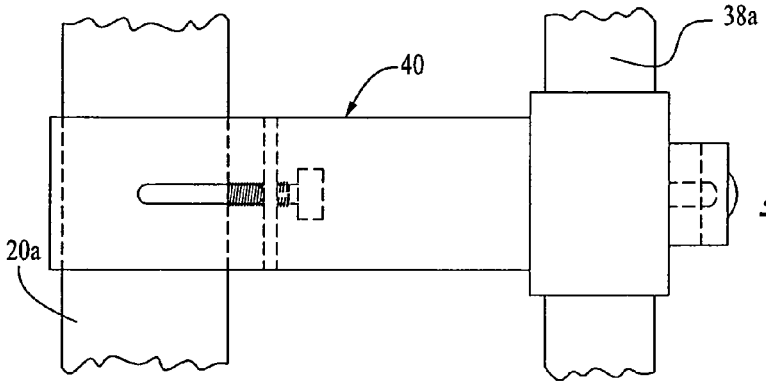
FIG. 5 is a top plan view of a bed board fasteners shown along line 5-5 in FIG. 3.
Figure 6:
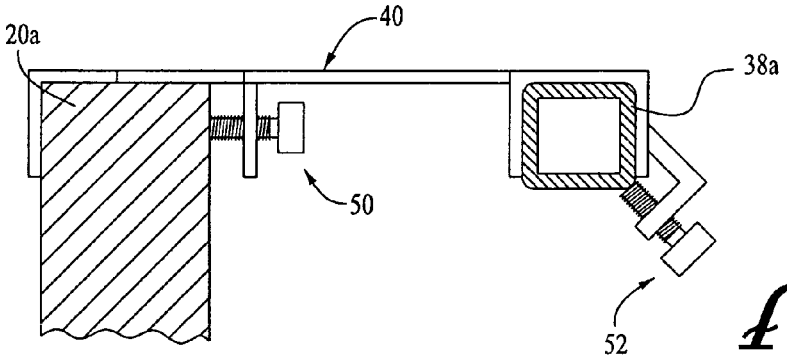
FIG. 6 is a sectional view of the bed board fastener fastened to a bed board of the bed shown along lines 6-6 of FIG. 3.

In FIG. 2, two bed board fasteners 40 on each attachment bar 38*a* and 38*b* are releasable fasteners for fastening the frame 12 to the bed 18. It is preferable to use one attachment bar on each end of the frame, and to use one or more fasteners on each bed board 20*a* and 20*b* of the bed 18 for greater stability. FIG. 5 and FIG. 6 show different views of the bed board fastener 40 connected to the attachment bar 38*a* and fastened to the bed boards 20*a* and 20*b* depicted in FIG. 3. FIG. 5 shows a top plan view of the bed board fastener depicted in FIG. 3 along lines 5-5. The bed board fastener 40 fastens the bed board 20*a* to the first attachment bar 38*a*.

As shown in FIG. 6, a bed board screw 50 fastens the bed board fastener 40 to the bed board 20*a*, and an attachment screw 52 fastens the bed board fastener 40 to the first attachment bar 38*a*. The first attachment bar 38*a* is outside of the bed board 20*a*, and the bed board screw 50 and the attachment screw 52 are also positioned outside of the bed board 20*a*. The installer can easily access the screws 50 and 52 to fasten or disengage the frame 12 of the enclosure 10 from the bed 18.

Figure 7:
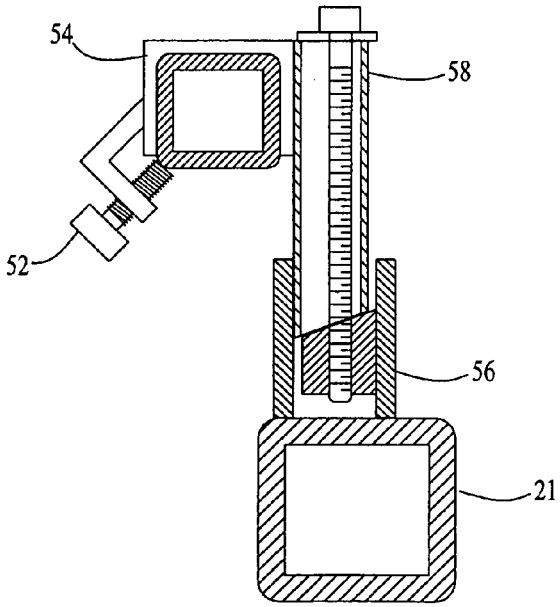
FIG. 7 shows a sectional view of another version of the invention wherein the frame of the enclosure is attached to an IV pole slot associated with the bed.
Figure 8:
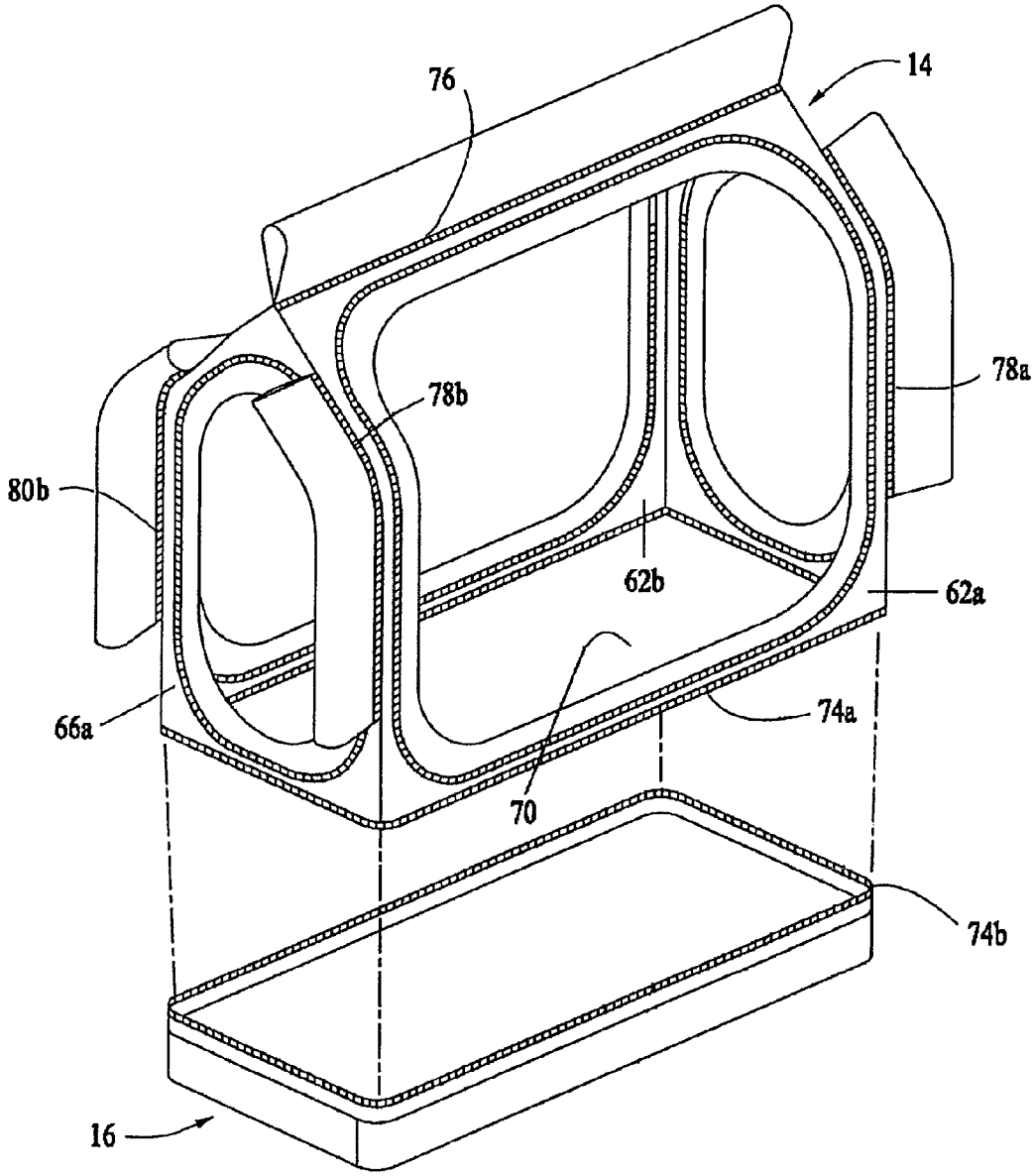
FIG. 8 is another exploded perspective view of a tent of the enclosure of FIG. 1 and a mattress cover.

In addition to the bed board fasteners 40, FIG. 7 shows a sectional view of an IV pole fastener 54 connected to the attachment bar 38*a* and fastened on the bed framework 21 having an IV pole slot 56. The IV hole fastener 54 has a downward member 58 that fits into the IV pole slot 56 located on the framework 21 of the bed, and an attachment screw 52 outside of the framework fastening the first attachment bar 38*a* to the IV pole fastener 54. The installer can easily access the attachment screw 52 to fasten or disengage the frame 12 of the enclosure 10 from the bed 18. In FIG. 7, the IV pole slot 56 is located on the framework 21 of the bed 18. An IV pole slot 56 can be found on bed board 20*a* and 20*b* of certain beds, and the IV pole fastener 54 also works with those types of beds (not shown in FIG. 7 or any other figures).

The bed board fasteners and IV fasteners described and shown in detail in the drawings are examples of fasteners adapted to fasten the frame to the bed. Other releasable fasteners can be used or adapted to fasten the frame to the bed, such as bolts, clamps, C-clamps, straps, ratchet straps, screws, and similar structures.

The frame's components can be constructed of any suitable rigid material, such as metal tubing. The preferred material used in the construction of the frame 12 was mild steel tubing. However, other materials that can be used include aluminum or cold rolled seamless steel.

Figure 3:
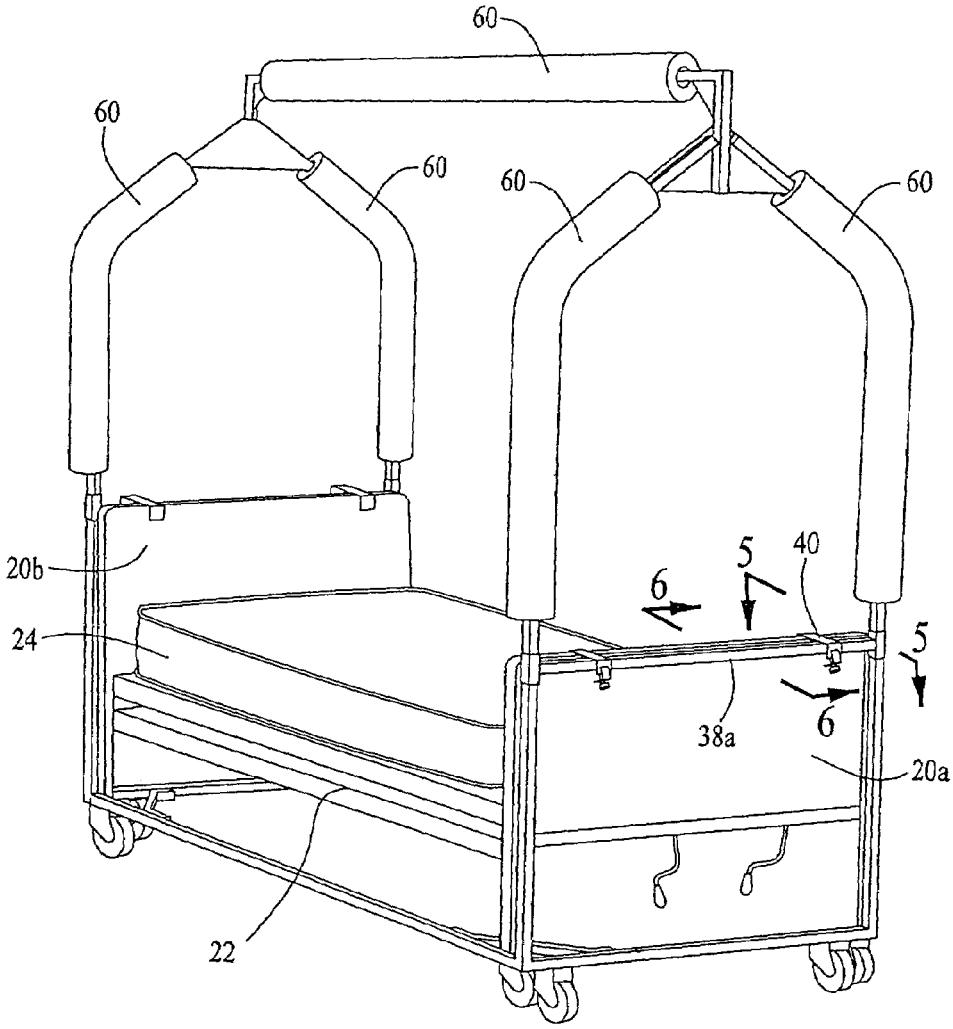
FIG. 3 is a perspective view of the frame of the enclosure of FIG. 1 installed on a bed and wherein the frame has padding.

As best shown in FIG. 3, the frame is 12 fastened to bed boards 20*a* and 20*b* of the bed 18 with bed board fasteners 40, and padding 60 covering the legs 44*a* and 44*b* of each opposed upright end members 34*a* and 34*b* and the upper support bar 36. The mattress 24 is seated on the mattress support 22 of the bed 18. It is preferable to use padding 60 to cover the metal bars that can come in contact with the patient inside of the tent for added safety.

Figure 4:
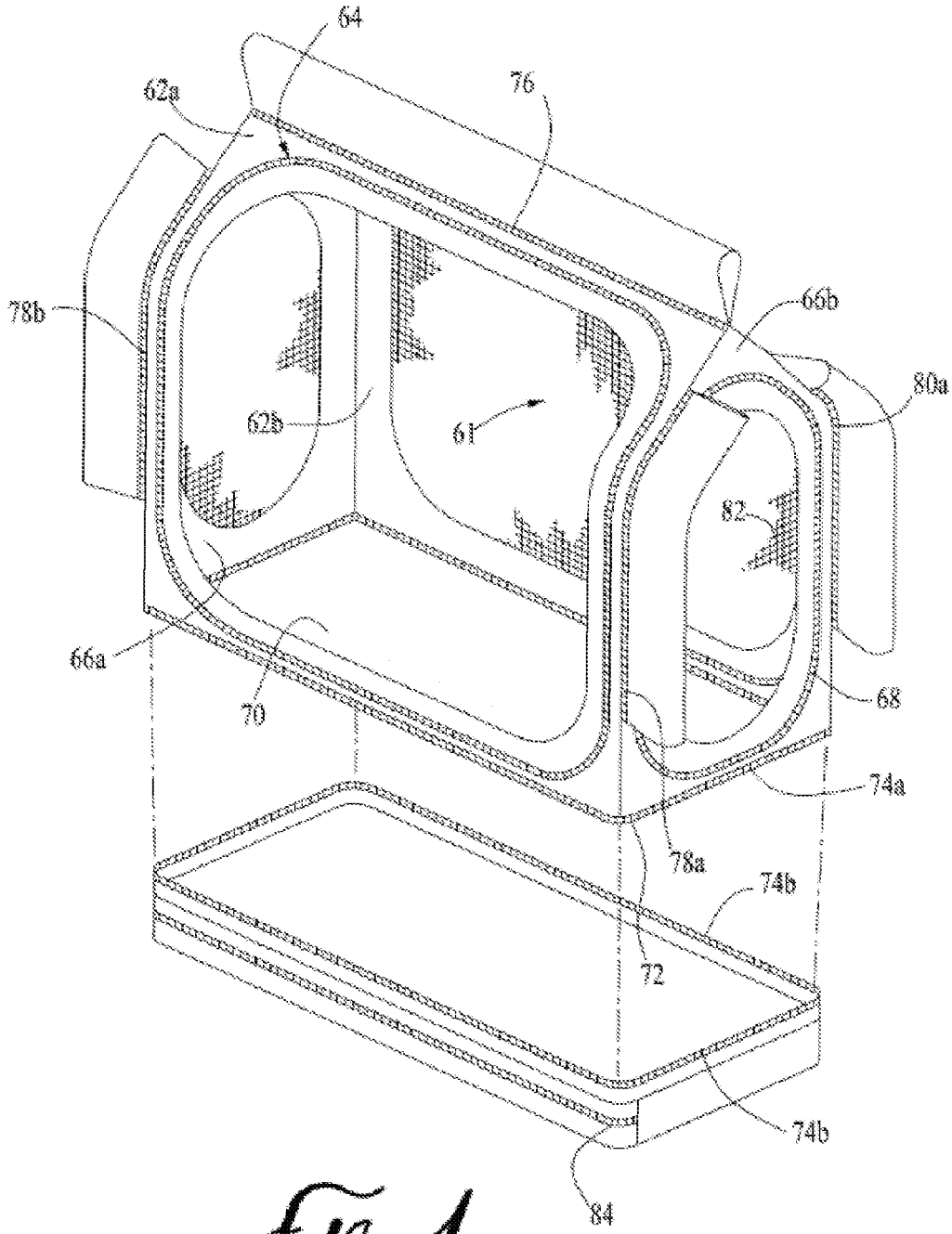
FIG. 4 is an exploded perspective view of a tent of the enclosure of FIG. 1 and a mattress cover.

As shown in FIG. 4, the tent 14 has a three dimensional interior section 61. The tent 14 comprises opposed side walls 62*a* and 62*b* with zippered side panels 64; opposed end walls 66*a* and 66*b* with zippered end panels 68; an open bottom 70, wherein each wall of the tent has a lower edge 72 on the open bottom 70 connected to one half of a first mated zipper connector 74*a*; a third mated zipper connector 76 between material covering the upper support bar and the tent 14, and a fourth pair of mated zipper connectors 78*a* and 78*b* and fifth pair of mated zipper connectors 80*a* and 80*b* between material covering the upright end members and adjoining material on the side walls 62*a* and 62*b* and end walls 66*a* and 66*b* of the tent 14. One of the fifth pair of mated zipper connectors 80*b* is not visible in the view shown in FIG. 4; but is located on the back rear corner of the tent 14 opposite 78*b* as shown in FIG. 4 and in the same relative position. The zippered side panels 64 and zippered end panels 68 have netting 82. The mattress cover 16 comprises the upper edge of the mattress cover 16 connected to other half of the first mated zipper connector 74*b*; and a second mated zipper connector 84 that permits the removal and insertion of a mattress 24.

The tent 14 can be made of any suitable material such as vinyl of varying thicknesses, canvas, laminated materials, cotton duck, polyester, heavy denier nylon, propylene, nylon mesh or cotton netting.

In the embodiments of the tent shown and described in this patent, each wall of the tent has a lower edge on the open bottom connected to one half of a first mated zipper connector that can be mated with the other half of the first mated zipper connector attached to the upper edge of the mattress cover to allow the tent to be removably connected to the mattress cover. The invention also contemplates that the lower edge of at least one wall of the tent is removably connected to the upper edge of the mattress cover, and that not all walls of the tent necessarily need to be connected to the mattress cover.

While the only depiction in the drawings is that of the first mated zipper connector, the invention contemplates that other types of connectors, would be encompassed by the invention if the substituted connectors would allow the tent to be removably connected to the mattress cover. For example, mated velcro strips, mated snaps, or other connectors could be used in place of the mated zipper connectors, as these could be removably connected between the tent and mattress cover. A preferred embodiment in the invention is the use of mated zipper connectors, including the first mated zipper connector, and the other mated zipper connectors.

Embodiments of the invention can include the frame having at least one side bar and an upper support bar that are adjustable in length. A preferred embodiment is the use of telescoping bars as the side bar and the upper support bar. Telescoping bars are bars that are adjustable in length, and the excess length of the bar is contained within the core of the bar when it is not expanded. Other embodiments of the invention can include a multiplicity of wheels connected the lower portion of the frame of the enclosure as shown in FIG. 1 and FIG. 2. Wheels on the frame make it easier to move and remove the enclosure especially in emergency situations.

A preferred version of the present invention offers several beneficial features for an enclosure restricting egress, such as to a hospitalized patient. One benefit of the version of the invention with a frame having an open side on the bottom of the frame is that devices such as a patient lifter can be easily positioned under the bed, and provide stability for safely lifting the patient in or out of the bed. Conventional enclosures with two closed sides under the bed that form a generally rectangular shape can obstruct access under the mattress support of the bed for using a patient lifter. This embodiment of the invention does not suffer from that problem.

Another benefit of having an open side on the bottom of the frame is that the frame of the enclosure can be easily constructed away from the bed, then moved to the location of the bed, and fastened to the bed framework or bed boards. The patient can even remain in the bed while the frame of the enclosure is attached to the bed. This is beneficial in many ways. A sedated patient or an alert but immobile patient does not need to be removed from the bed before attaching the enclosure. The enclosure can be quickly removed from beds with minimal effort because the frame slides around the bed for attachment or removal at the ends of the bed. The installer does not need to spend time in the cramped area under the bed when attaching the enclosure to the bed's frame. This makes installation and removal of the enclosure a less time consuming task for the installer.

Another benefit of the present invention is a preferred embodiment with the frame of the enclosure having one or more attachment bars moveable up and down along at least a portion of the length of the legs of the upright end members. This is beneficial because when the bed is raised or lowered, each attachment bar fastened to the bed will move up or down, and thereby permit the enclosure to remain safely around the patient. This feature makes it easy for a care giver, such as a doctor, nurse, or other person, to raise the bed to a level that is comfortable for access to the patient, and without needing major adjustments to ensure the enclosure remaining safely around a patient with the tent.

A preferred embodiment of the invention having a first mated zipper connector offers important benefits for an enclosure restricting egress. First, the first mated zipper connector makes the enclosure safer for the patient because the mattress is enclosed, and the patient lying on top of the mattress cover cannot get trapped between the mattress cover and the mattress. Second, when the tent of the enclosure of the present invention is removably connected with one half of a first mated zipper connector to the upper edge of the mattress cover with the other half of a first mated zipper connector, this permits the tent to be quickly unzipped from the mattress cover, and from around the patient within the tent. For example, in an emergency situation, unzipping the first mated zipper connector and pushing the tent away from the patient allows greater access to the patient inside the enclosure.

The other mated zipper connector of the present invention are preferred embodiments that also offer benefits. The third mated zipper connector, fourth pair of mated zipper connectors, and fifth pair of mated zipper connectors are beneficial for installation and removal of the tent. These mated zipper connectors permit simple installation of the tent around a bed. For example, when the frame is constructed away from the bed, and moved into position surrounding the bed frame, the use of these mated zipper connectors, permits an installer to support the tent over the padding or the frame, even when a patient is in the bed. The same is true with respect to removal of the tent from the frame for disassembly. The second mated zipper connector permits the removal and insertion of a mattress. The use of these mated zipper connector is a preferred embodiment of the invention.

An above preferred embodiment of the tent having a first mated zipper connector, used with an open side on the bottom of the frame, and with releasable fastener means attached to an attachment bar provides a quick way to remove the tent, disengage the frame, and push the frame away from the bed. The use of these three prominent features of the invention is a preferred embodiment of the invention for all of the above reasons.

A variety of different permutations of the invention is contemplated, and not meant to be limited by this disclosure. The present invention is not limited to the preferred embodiments described in this section. The embodiments are merely exemplary, and one skilled in the art will recognize that many others are possible in accordance with this invention. Having now generally described the invention, the same will be more readily understood through references to the above descriptions and drawings, which are provide by way of illustration, and are not intended to be limiting of the present invention, unless so specified.

Having thus described the invention, it should be apparent that numerous modifications and adaptations may be resorted to without departing from the scope and fair meaning of the instant invention as set forth herein above and as described herein below by the claims.

Although the present invention has been described in considerable detail with reference to certain preferred versions thereof, other versions are possible. Therefore, the spirit and scope of the appended claims should not be limited to the description of the preferred versions described herein.

All features disclosed in the specification, including the claims, abstracts, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means" for performing a specified function or "step" for performing a specified function, should not be interpreted as a "means" or "step" clause as specified in 35 U.S.C. § 112.

The above description in the "Background" section is to provide a summary of information relevant to the present invention and is not a concession that any of the information provided or publications referenced herein is prior art to the presently claimed invention.

What is claimed is:

1. A frame for supporting a tent for restricting egress from a bed having a bottom portion, comprising:

a) a pair of opposed end bars, each end bar having a first end segment and a second end segment;

b) a side bar connected to the first end segment of each end bar, wherein there is no side bar connected to the second end segments, to define a generally rectangular shape with an open side allowing unobstructed access underneath the bottom portion of the bed;

c) first and second opposed upright end members, each upright end member comprising two substantially upright legs, each upright leg having an upper portion and a lower portion, the lower portion of each upright leg being connected to said opposed end bars;

d) a substantially V-shaped connector segment connecting the upright legs of each upright end member at the upper portion, the V-shaped connector segment extending between and connected to each upright leg of an upright end member; and e) an upper support bar extending between and connected to the upright end members.

2. The frame of claim 1 further comprising:

f) a first attachment bar, the first attachment bar being connected between the legs of one upright end member, the first attachment bar being moveable up and down along at least a portion of the length of the legs of the upright end member; and g) releasable fastener means connected to the first attachment bar for fastening the first attachment bar to the bed.

3. The frame of claim 2 wherein the side bar and the upper support bar are adjustable in length.

4. The frame of claim 3 wherein the side bar and the upper support bar are telescoping bars.

5. The frame of claim 2 wherein the releasable fastener means fastens to an IV pole slot on the bed.

6. An enclosure for restricting egress to a bed comprising: the frame of claim 1, and the tent supported by the frame, wherein the tent comprises a three dimensional interior section.

7. The enclosure of claim 6 wherein the tent has opposed side walls, opposed end walls, and an open bottom, wherein each wall of the tent has a lower edge on the open bottom and at least one wall of the tent has one half of a first mated zipper connector, further comprising a mattress cover having an upper edge and the other half of the first mated zipper connector, for connecting the one half of the first mated zipper connector on the lower edge of at least one wall of the tent to the other half of the first mated zipper connector on the upper edge of the mattress cover.

8. An enclosure for restricting egress to a bed, comprising:

a frame comprising:

i) a pair of opposed end bars;

ii) a side bar connected to the opposed end bars;

iii) first and second opposed upright end members, each end member comprising two substantially upright legs having an upper portion and a lower portion, each end member being connected to the opposed end bars;

iv) an upper support bar extending between and connected to the upright end members;

v) a first attachment bar connected between the legs of the first upright end member, the first attachment bar being moveable up and down along at least a portion of the length of the legs of the first upright end member; and vi) a releasable fastener connected to the first attachment bar for fastening the first attachment bar to the bed; and b) a tent supported by the frame, wherein the tent comprises a three dimensional interior section.

9. The enclosure of claim 8, wherein the frame further comprises a second attachment bar connected between the legs of the second upright end member, the second attachment bar being moveable up and down along at least a portion of the length of the legs of the second upright end member.

10. The enclosure of claim 8, wherein the releasable fastener is adapted to fasten to an IV pole slot on the bed.

11. The enclosure of claim 8, wherein the releasable fastener is adapted to fasten to a bed board on the bed.

12. The enclosure of claim 8 further comprising a mattress cover with an upper edge, wherein the tent has opposed side walls, opposed end walls, and an open bottom, and wherein each wall of the tent has a lower edge, with at least one wall of the tent at the lower edge being removably connected to the upper edge of the mattress cover.

13. A structure supported by a frame for restricting egress from a bed, the frame comprising an upper support bar extending between two opposed upright end members, comprising:

a) a tent comprising opposed side walls, opposed end walls, and an open bottom, wherein each wall of the tent has a lower edge on the bottom;

b) a mattress cover with an upper edge, wherein the lower edge of at least one wall of the tent is removably connected with one half of a first mated zipper connector to the upper edge of the mattress cover with the other half of the first mated zipper connector;

c) a third mated zipper connector between material covering the upper support bar and the tent; and d) a pair of fourth mated zipper connectors and a pair of fifth mated zipper connectors between material covering the upright end members and adjoining material on the side walls and end walls of the tent.

14. The structure of claim 13 wherein the mattress cover further comprises a second mated zipper connector that permits removal and insertion of a mattress.

15. An enclosure for restricting egress to a bed having a bottom portion, comprising:

a) a frame comprising:

i) a pair of opposed end bars, each end bar having a first end segment and a second end segment;

ii) a side bar connected to the first end segment of each end bar, wherein there is no side bar connected to the second end segments, to define a generally rectangular shape with an open side allowing unobstructed access underneath the bottom portion of the bed;

iii) first and second opposed upright end members, each end member comprising two substantially upright legs having an upper portion and a lower portion, each upright leg being connected to said opposed end bars;

iv) an upper support bar extending between and connected to the upright end members;

v) a first attachment bar connected between the legs of the first upright end member, the first attachment bar being moveable up and down along at least a portion of the length of the legs of the first upright end member;

vi) a releasable fastener connected to the first attachment bar for fastening the first attachment bar to the bed;

b) a tent comprising opposed side walls, opposed end walls, and an open bottom, wherein each wall of the tent has a lower edge on the open bottom and at least one wall of the tent has one half of a first mated zipper connector; and c) a mattress cover having an upper edge and the other half of the first mated zipper connector, for connecting the one half of the first mated zipper connector on the lower edge of at least one wall of the tent to the other half of the first mated zipper connector on the upper edge of the mattress cover.

16. The enclosure of claim 15 further comprising a second attachment bar connected between the legs of the second upright end member, and the second attachment bar being moveable up and down along at least a portion of the length of the legs of the second upright end member.

17. The enclosure of claim 16 wherein the mattress cover further comprises a second mated zipper connector that permits removal and insertion of a mattress.

18. The structure of claim 16 further comprising a third mated zipper connector between material covering the upper support bar and the tent, and a pair of fourth mated zipper connectors and a pair of fifth mated zipper connectors between material covering the upright end members and adjoining material on the side walls and end walls of the tent.

19. A bed enclosure supported by a frame, the frame comprising an upper support bar connected to a first pair of upright legs and a second pair of upright legs, comprising:

a) a tent comprising opposed side walls, opposed end walls, and an open bottom, wherein each wall of the tent has a lower edge;

b) a mattress cover with an upper edge, wherein the lower edge of at least one wall of the tent is removably connected to the upper edge of the mattress cover with a first mated zipper connector, the mattress cover further comprising a second mated zipper connector that permits removal and insertion of a mattress;

c) a third mated zipper connector between material covering the upper support bar and the tent; and d) a pair of fourth mated zipper connectors and a pair of fifth mated zipper connectors between material covering the upright legs and adjoining material on the side walls and end walls of the tent.

* * * * *